United States Patent [19]

Sandrini

[11] Patent Number: 4,870,844

[45] Date of Patent: Oct. 3, 1989

[54] OBJECT SEPARATOR SUPPORTED AND HOOKED TO A SINGLE RING-LIKE COMPONENT

[75] Inventor: Furio M. Sandrini, Milan, Italy

[73] Assignee: Fashion Design Studio S.r.l., Milan, Italy

[21] Appl. No.: 210,663

[22] Filed: Jun. 21, 1988

[30] Foreign Application Priority Data

Jun. 24, 1987 [IT] Italy ..... 21027 A/87

[51] Int. Cl.[4] ..... A47G 29/10

[52] U.S. Cl. ..... 70/456 R

[58] Field of Search ..... 70/456 R, 456 B, 457–459; 150/40; D3/61; 24/3 K

[56] References Cited

U.S. PATENT DOCUMENTS

| | | | |
|---|---|---|---|
| 548,065 | 10/1895 | Keys | 70/456 R |
| 2,422,436 | 6/1947 | Ppavd | 70/456 R |
| 2,473,758 | 6/1949 | Maillon | 70/456 R |
| 2,503,380 | 4/1950 | Derby | 70/456 R |
| 2,636,053 | 5/1950 | Starrett | 70/456 R |
| 2,683,734 | 4/1953 | Genovese | 70/456 R |
| 3,908,418 | 9/1975 | Stoffel | 70/456 R |
| 4,062,212 | 12/1977 | Klein | 70/456 B |
| 4,601,185 | 7/1986 | Sheldon | 70/456 R |

*Primary Examiner*—Robert L. Wolfe

*Attorney, Agent, or Firm*—Bucknam and Archer

[57] ABSTRACT

The separator is composed of two elements (1) basically alike, each one made up of three sectors (2) and (3) hinged to each other and folded (4). The two components (1) are coupled in a movable fashion to each other in the opposed direction, by means of eyelets (6) or (6') to be found on the projecting ends of the outer sectors (3). The coupling forms a single folding and upturnable element to which is coupled a ring-like body (7), (8) or (9) inserted into said eyelets (6) or (6').

1 Claim, 2 Drawing Sheets

OBJECT SEPARATOR SUPPORTED AND HOOKED TO A SINGLE RING-LIKE COMPONENT

The invention consists of a separator for objects supported and hooked to a single ring-like element, especially suitable for the support and separation of keys, tools, various accessories, camping utensils, sample kits and so on, including two folding and upending components, constrained to each other by means of ring-like eyelets and coupled to a ring-like body which, passing through said eyelets, divides its extension into two separate and distinct parts.

To better understand the novel concept of this invention, given as an example, reference is made to the simplest and most common of its applications: the keyholder.

It is well known that in a large number of cases, the keys in general are for the most part constrained to a ring-like body from which, thanks to its configuration, each separate key must be easily used, independently of the others hanging on the ring-like body.

However, it very often happens that, under these conditions, the user has some difficulty in finding and separating the key or keys to be used at a specific time, among all those included in the bunch, hanging on the single ring-like body. Another drawback is due to the fact that when using a particular key, such as, for example, the car starting key, the others attached to the same ring-like body knock against each other and jingle in a very annoying fashion.

Other drawbacks, connected with different applications, derive from the fact that certain objects, such as, for example, camping tools, campers' cutlery, manicure sets, measuring utensils and so on, if hung on a single ring-like body, are awkward to use because the other objects get in the way and are encumbering, since they are in no way separated from each other.

The object of this invention is to eliminate these above-mentioned drawbacks.

The invention, as it is characterized by the claims, solves the problem by means of a separator for objects supported and hung on a single ring-like element, through which the following results are obtained: the two coupled components, composing the separator, are easily upended between each other, releasing and/or collecting one or more than one object hung on a common ring-like body; the objects, separated according to their purposes, uses or functions to which they are intended, are released or collected, and at any rate are kept separate from the coupled components according to the selection chosen and decided on by the users; each ring-like body is preferably, but not restrictively equipped with a separator made up of two coupled components.

The advantages deriving from this invention consist mainly of the fact that, during use of one or several keys or one or several objects hanging on a ring-like body, the other objects hanging on the same body are kept separate and gathered together in such a way as not to be encumbering and to facilitate the use of the one or ones selected.

The invention is heretofore explained in detail, with reference to the enclosed drawings, in which.

Figure 1:
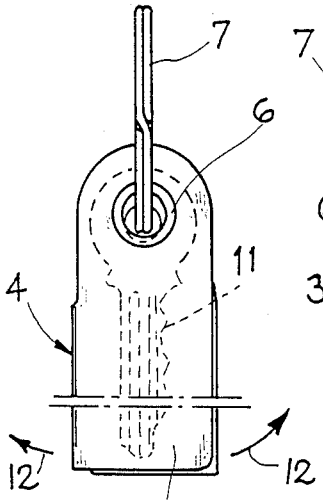
FIG. 1 shows a closed separator seen in a side view.
Figure 2:
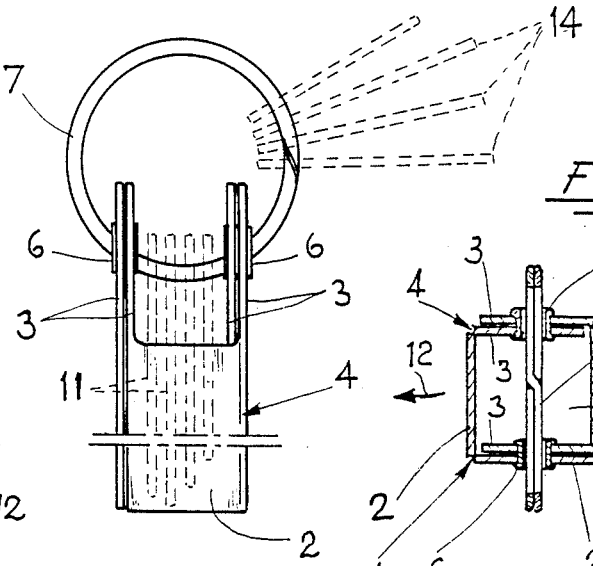
FIG. 2 shows a closed separator seen in a front view.
Figure 3:
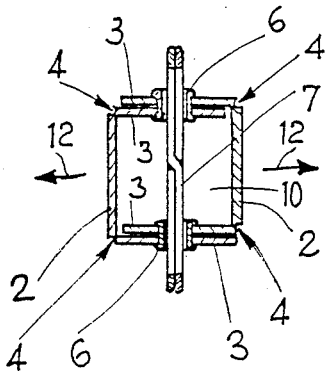
FIG. 3 shows a closed separator in horizontal section.
Figure 4:
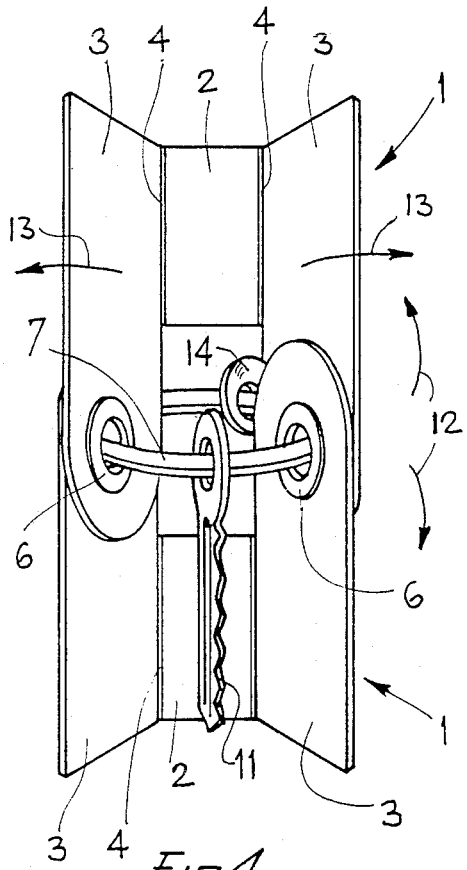
FIG. 4 shows a partly open separator, folded and being upended.

The drawings show a separator for objects supported and hooked to a single ring-like element, including two components (1) alike. Each component (1) consists of two sectors (2) and (3) connected to each other by means of folding hinges (4). The outer sectors (3) have upper, more extended ends on which are machined through holes (5) in which are engaged connection eyelets (6). The eyelets may be of a separate type (6), or machined as one with the component and projecting (6') along the circumference of at least one of the through-holes (5) existing on the ends of the outer sectors (3).

The folding hinges (4), on the other hand, are extended along the parallel sides of the sectors (2) and (3); these may be machined directly with the parallel sectors (2) and (3) by means of nicking or preforming of the material which they are made of. This is possible when the components (1) are made of plastic material or the like, such as, for example, polypropylene, In fact, this material, thanks to its characteristics of flexibility and resistance, permits the components (1) to be made by a single molding process with preforming of the hinges (4), mainly composed of lines of limited thickness which permit illimited foldings according to their extension.

In other solutions, as, for example, those having sectors (2) and (3) in metal or other stiff material, the hinges (4) are attached separately and they too are made of metal or in another suitable material. Further realizations may consist of sectors (2) and (3), in stiff materials glued or added to continuous and flexible strips which comprise the hinges (4).

In any case, the two components (1) made up of sectors (2) and (3), are connected to each other in an opposed position; that is to say, the upper extended ends of the sectors (3) are coupled head on and constrained to each other by means of said eyelets (6) or (6'). Application of the eyelets (6) is obtained in the same way as for rivets, studs, through holes and so on, or by means of a machine exerting pressure devised for this purpose; constraint with the rivets (6') may, on the other hand, be obtained either by mechanical pressure or, more simply, by manual pressure; the projecting lip of the eyelets (6) is pressed against the edge of a hole (5) until it gives way yieldingly and passes beyond the thickness of the sectors (3), in which position it regains, elastically its external proportions increased with respect to said hole (5). The eyelets (6) or (6') as well as constituting tje connecting elements of the two coupled components (1), form the pivots around which the components themselves may be freely made to rotate and the through holes (5) through which a circular (7), polygonal (8) or another (9) ringlike body is engaged.

In one of the above-mentioned ways, the components (1), thanks to their configuration in sectors (2) and (3) connected and foldable along the hinges (4), may rotate and be folded both in one direction and in the opposite one.

For better clarity and with reference to the drawings from 1 to 5, starting from a closed position in which the two components (1) are basically folded one on the other to form a recess (10) inside which the keys (11) may be closed, the same components may be opened up by exerting a pulling motion in the direction of the arrows (12).

Figure 5:
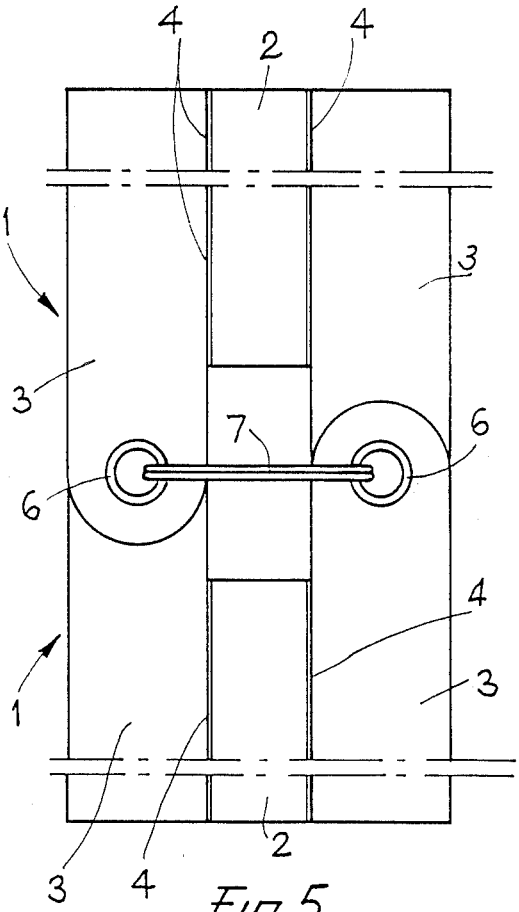
FIG. 5 shows a separator in a completely open position, before being folded, either in one direction or the other, and then upended to be reclosed.
Figure 6:
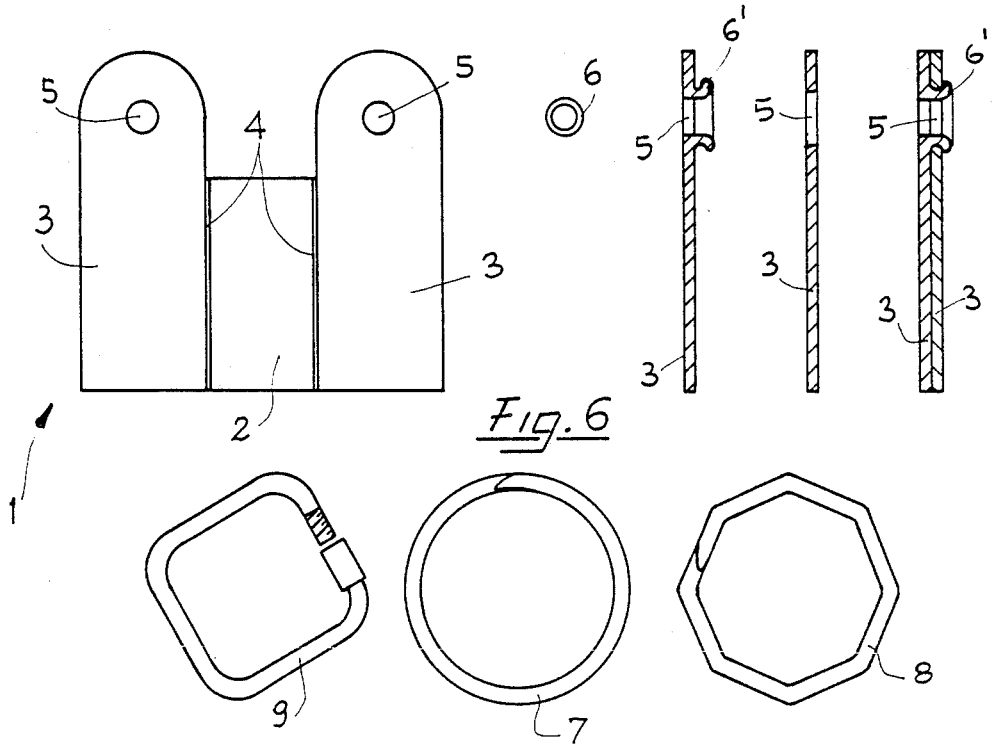
FIG. 6 shows the basic components, with some possible variations, of which a separator is composed
Figure 7:
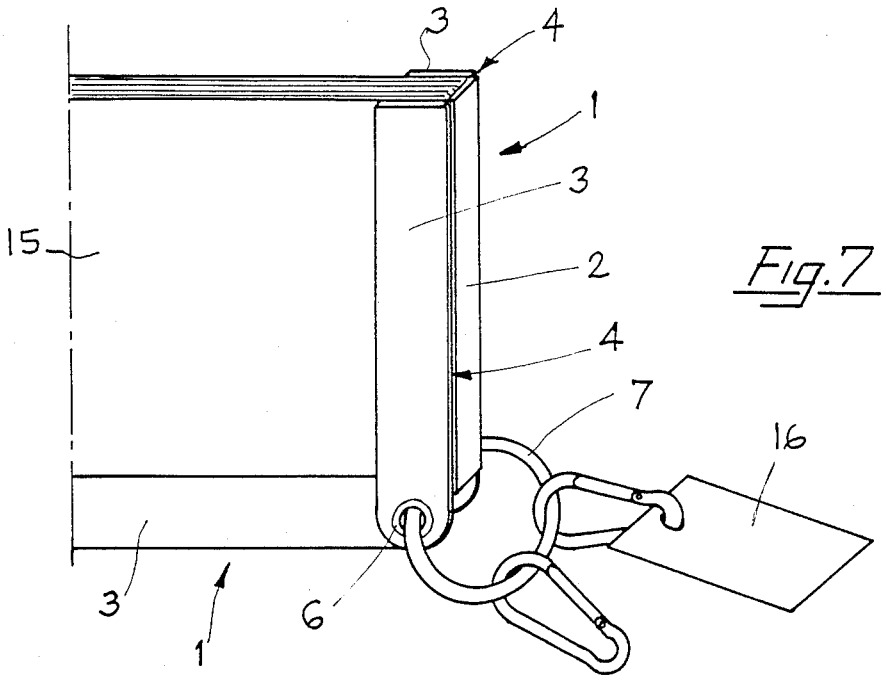
FIG. 7 shows another example of application and use of the separator.

During the open phase, in view of the fact that the eyelets (6) or (6') follow the trend of the ring-like body (7), (8) or (9), the components (1) are also compelled to open, following the direction of the arrows (13); once they are opened to their utmost, as in FIG. 5, the key or keys (11) are then completely released from the grip of the components (1), whereas as the rotation proceeds, the same components are brought back to a closed position, the same as the previous one, but with a diametrically opposed position, in respect to the ring-like body (7), (8) or (9).

In the new closed position, basically identical in configuration to the starting one, the components (1) form another recess (10) in which are now gathered, for example, the keys (14) which were previously free.

It may be understood that, on a single ring-like body (7), (8), (9), circular, polygonal or of any other type, several objects of the same or different type may be hung, amongst amongst which, however, it is wished to keep a clear separation in such a way as to facilitate their selection and use. Consequently, for example, a bunch of keys may be divided up into town house keys and those belonging to the house at the seashore or in the mountains, or into house keys and those belonging to the office or the car.

Vice-versa, in other applications, the separator may carry out its function with working tools, such as, for example, thickness gauges and torque spanners, or with other objects or working utensils, such as fabric samples, linings, woods or the like (15) and other articles or plates (16) with indications or other special specifications and so on. In the sporting field or with camping articles, the separator may divide up a jack-knife, files, screwdrivers from folding cutlery, from the nail set, from scissors and sewing accessories and so on.

It goes without saying that even if the solution using a single separator with a ring-like body (7), (8) or (9) is the simplest and most functional, on a similar ring-like body, possibly of adequate dimensions, one may apply even more than one separator which may perform more specific containment functions for objects divided into groups.

I claim:

1. A separator for supporting and separating keys and the like which comprises one first and one second alike components (1), each component (1) being composed of two sectors (3) hinged to an intermediate sector (2) along folding lines (4), each of said sectors (3) having an extension at its upper end an orifice in each of said upper ends of said sectors, an eyelet in each orifice, said two components being arranged one with the two upper ends at the top and the other component being inverted with the orifices and the eyelets at the bottom, a ring-like element passing through said eyelets in such a manner that one of the eyelets of said one first component is on the exterior with respect to one eyelet of said second component and the other eyelet of the first component being arranged in the interior with respect to the other eyelet of said second component, said keys being suspended from said ring-like element, said components being free to rotate on said ring-like element whereby one, two, three or four partitions may be obtained for separating one of said keys.

* * * * *